United States Patent [19]

Mikawa

[11] 4,198,240

[45] Apr. 15, 1980

[54] SILVER HALIDE PHOTOGRAPHIC EMULSION

[75] Inventor: Akikazu Mikawa, Minami-ashigara, Japan

[73] Assignee: Fuji Photo Film Co., Ltd., Minami-ashigara, Japan

[21] Appl. No.: 912,771

[22] Filed: Jun. 5, 1978

[30] Foreign Application Priority Data

Jun. 3, 1977 [JP] Japan ..... 52/65442

[51] Int. Cl.[2] ..... G03C 1/28; G03C 1/34

[52] U.S. Cl. ..... 430/570; 430/611

[58] Field of Search ..... 96/107, 109, 94 R

[56] References Cited

U.S. PATENT DOCUMENTS

| | | | |
|---|---|---|---|
| 2,394,198 | 2/1946 | Mueller | 96/109 |
| 2,521,926 | 9/1950 | Lowe et al. | 96/107 |
| 3,021,215 | 2/1962 | Williams et al. | 96/107 |
| 3,038,805 | 6/1962 | Dann et al. | 96/107 |
| 3,047,393 | 7/1962 | Herz et al. | 96/109 |
| 3,062,646 | 11/1962 | Dann et al. | 96/107 |

OTHER PUBLICATIONS

Birr, Stabilization of Photograhic Silver Halide Emulsions, Oct, 1975, pp. 45–50.

*Primary Examiner*—Won H. Louie, Jr.

*Attorney, Agent, or Firm*—Sughrue, Rothwell, Mion, Zinn and Macpeak

[57] ABSTRACT

A silver halide photographic emulsion, whose sensitivity is enhanced without fogging, containing at least one organic thioether compound and at least one compound represented by the formulae (I), (II) and/or (III):

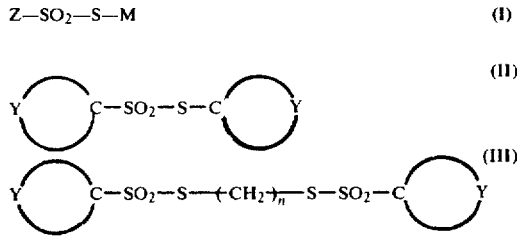

wherein Z is an alkyl group having 1 to 18 carbon atoms, an aryl group having 6 to 18 carbon atoms or a heterocyclic group; Y represents the atoms necessary for forming an aromatic ring having 6 to 18 carbon atoms or a heterocyclic ring; M is a metal atom or an organic cation; and n is an integer of 2 to 10.

12 Claims, No Drawings

SILVER HALIDE PHOTOGRAPHIC EMULSION

BACKGROUND OF THE INVENTION

1. Field of the Invention

The present invention relates to silver halide photographic emulsions, and, more particularly, to silver halide photographic emulsions containing the combination of at least one organic thioether compound and at least one thiosulfonic acid compound.

2. Description of the Prior Art

It is well known to use organic thioether compounds as a solvent for silver halide or chemical sensitizers, etc., in the preparation of a silver halide photographic emulsion.

For example, a technique for preparing a so-called monodisperse emulsion having a uniform silver halide particle size by allowing an organic thioether compound to be present during precipitation and during physical ripening in the preparation of a silver halide photographic emulsion (hereafter simply referred to as an "emulsion") is disclosed in U.S. Pat. Nos. 3,271,157, 3,531,289, 3,574,628, etc.

Further, a technique for increasing the photographic sensitivity of an emulsion by allowing an organic thioether compound to be present during chemical ripening, etc., in the preparation of an emulsion is disclosed in U.S. Pat. Nos. 2,521,926, 3,021,215, 3,038,805, 3,057,724, 3,062,646, 3,574,709, 3,622,329, 3,625,697, etc.

However, if an organic thioether compound is present during the preparation of emulsions, there is a tendency for fog to be increased.

In order to prevent this fogging due to the presence of organic thioether compounds, for example, techniques for precipitating at a pH below 4 or super-purifying organic thioether compounds are known. However, all of these techniques are disadvantageous since the effects achieved are insufficient or they are not practical on an industrial scale.

SUMMARY OF THE INVENTION

Therefore, a first object of the present invention is to provide emulsions which are not fogged even if photographic sensitivity is enhanced using organic thioether compounds during the preparation of the emulsions.

A second object of the present invention is to provide a process for preventing an increase in fog in emulsions in which photographic sensitivity is enhanced using organic thioether compounds.

These objects of the present invention are achieved with a silver halide emulsion containing at least one organic thioether compound and at least one compound represented by the formulae (I), (II) and/or (III) indicated below.

$$Z-SO_2-S-M \quad \text{(I)}$$

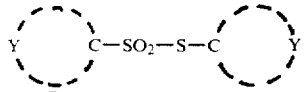

(II)

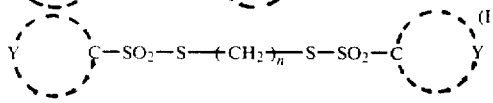

(III)

wherein Z is an alkyl group having 1 to 8 carbon atoms, an aryl group having 6 to 18 carbon atoms or a heterocyclic group; Y represents the atoms necessary for forming an aromatic ring having 6 to 18 carbon atoms or a heterocyclic ring; M is a metal ion or an organic cation; and n is an integer of 2 to 10.

DETAILED DESCRIPTION OF THE INVENTION

The organic thioether compound which is preferred in the present invention is represented by the formula (A) or (B) indicated below.

$$Q\{(CH_2)_r CH_2-S-(CH_2)_2X-(R)_p(CH_2-)_2R')_q S-CH_2-(CH_2)_m Z\}_n \quad \text{(A)}$$

$$Q-(CH_2)_m CH_2-S-(CH_2)_n S-(CH_2-CH_2)_r Z \quad \text{(B)}$$

wherein r and m each is an integer of 0 to 4; n is an integer of 1 to 4; p and q each is an integer of 0 to 3; X is an oxygen atom, a sulfur atom, a $$-\overset{O}{\overset{\|}{C}}NH- \text{ group, a } -\overset{O}{\overset{\|}{C}}- \text{ group or a } -\overset{O}{\overset{\|}{C}}-O- \text{ group;}$$

R and R' each is an ethyleneoxy group; and Q and Z, which may be the same or different, each is an —OR'' group, a $$-\overset{O}{\overset{\|}{C}}-OR'' \text{ group, or a } -\overset{O}{\overset{\|}{C}}-NH_2 \text{ group,}$$

wherein R'' is a hydrogen atom or an alkyl group having 1 to 5 carbon atoms, such as a methyl group, an ethyl group, etc., which can be substituted, e.g., with a hydroxy group or a carboxy group, and further, Q and Z each represents the substituents described for X with a cyclic compound being formed.

Preferred compounds of the compounds represented by the formula (A) or (B) are represented by the formulae (C) through (H) below.

$$HO-R^2-(S-R^4)_r S-R^2-OH \quad \text{(C)}$$

$$(HO-R^2-S-R^2-O-R^4)_2 \quad \text{(D)}$$

$$(R^3-O-R^2-S-R^2-\overset{O}{\overset{\|}{C}}-NH-R^4)_2 \quad \text{(E)}$$

$$(R^3-O-R^2-S-R^2)_2S \quad \text{(F)}$$

$$(R^3-NH-\overset{O}{\overset{\|}{C}}-R^2-S-R^2)_2-O \quad \text{(G)}$$

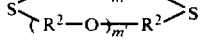

(H)

wherein r' is an integer of 0 to 3; m' is an integer of 1 or 2; $R^2$ and $R^4$ each is an alkylene group having 1 to 5 carbon atoms, such as a methylene group or an ethylene group; and $R^3$ is an alkyl group having 1 to 5 carbon atoms, such as an ethyl group.

Specific examples of organic thioether compounds which can be advantageously employed in the present invention include the following compounds:

$$HO\text{-}(CH_2)_2S\text{-}(CH_2)_2S\text{-}(CH_2)_2OH \quad (1)$$

$$HO\text{-}(CH_2)_3S\text{-}(CH_2)_2S\text{-}(CH_2)_3OH \quad (2)$$

$$HO\text{-}(CH_2)_2S\text{-}(CH_2)_2S\text{-}(CH_2)_2S\text{-}(CH_2)_2OH \quad (3)$$

$$[HO\text{-}(CH_2)_2S\text{-}(CH_2)_2O\text{-}CH_2]_2 \quad (4)$$

$$[HO\text{-}(CH_2)_5S\text{-}(CH_2)_5O\text{-}(CH_2)_2]_2 \quad (5)$$

$$[C_2H_5\text{-}O\text{-}(CH_2)_2S\text{-}(CH_2)_2]_2S \quad (6)$$

$$[CH_3\text{-}O\text{-}(CH_2)_4S\text{-}(CH_2)_4]_2S \quad (7)$$

$$[CH_3\text{-}NH\text{-}\overset{O}{\overset{\|}{C}}\text{-}(CH_2)_2S\text{-}(CH_2)_2]_2O \quad (8)$$

$$[C_2H_5\text{-}NH\text{-}\overset{O}{\overset{\|}{C}}\text{-}(CH_2)_3S\text{-}(CH_2)_3]_2O \quad (9)$$

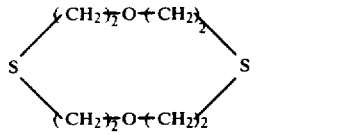

(10)

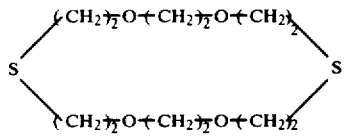

(11)

$$[NH_2CO\text{-}(CH_2)_2S\text{-}(CH_2)_2CONH\text{-}CH_2\text{-}]_2 \quad (12)$$

$$HOOC\text{-}CH_2\text{-}S\text{-}(CH_2)_3S\text{-}CH_2\text{-}COOH \quad (13)$$

$$[CH_3\text{-}O\text{-}(CH_2)_2\text{-}S\text{-}(CH_2)_2\text{-}\overset{O}{\overset{\|}{C}}\text{-}NH\text{-}CH_2\text{-}]_2 \quad (14)$$

Ordinary methods for synthesizing these organic thioether compounds employed in the present invention can be used. For example, reference can be made to British Pat. No. 950,089, U.S. Pat. No. 3,021,215, Journal of Organic Chemistry, Vol. 26, pages 1991–1995 (1961), etc.

In the present invention, the organic thioether compounds are added at least during the precipitation of the silver halide grains, during physical ripening subsequent to physical ripening, during chemical ripening or immediately before coating, in the preparation of the emulsion. Suitable silver halide grains include grains of silver halides such as silver chloride, silver bromide, silver iodide, silver chlorobromide, silver chloroiodide, silver bromoiodide and silver chlorobromoiodide.

In the present invention, conventional methods well known in the photographic art can be employed for forming silver halide grains, but, in particular, a double jet method is preferred.

The double jet method comprises adding simultaneously both an aqueous solution of a water-soluble silver salt (e.g., silver nitrate) and an aqueous solution of at least one halide (e.g., an alkali metal halide such as potassium bromide) to a solution of a protective colloid (e.g., gelatin or a gelatin derivative) for silver halide grains which is being stirred, using two separate jets.

In order to incorporate the organic thioether compounds during precipitation of the silver halide and/or during physical ripening, it is preferred for these to be added to a solution of a protective colloid prior to the initiation of the precipitation. However, these compounds can also be added, during precipitation, to the protective colloid solution, through a jet for adding the halide described above and/or a jet for adding the aqueous silver salt solution, or through another jet.

There is no special limitation on conditions such as pH, pAg, temperature or the like on formation of the silver halide grains in the present invention. However, it is preferred for the pH range be kept at about 1 to about 9, more preferably 2 to 6, and the pAg range to be between about 5 and about 11, more preferably between 7.8 and 10.5.

Silver halide grains can be formed at temperatures between about 30° and about 90° C. with particularly preferred temperatures being between 35° and 80° C.

Of course, the pH, pAg and temperature can be varied during the formation of silver halide grains, if desired.

A preferred amount of the organic thioether compounds added during the formation of the silver halide grains is about 0.01 to about 100 g, more preferably 0.1 to 10 g, per mol of silver halide.

In general, where the organic thioether compounds are added during the formation of the silver halide grains, they are used as solvents for silver halide grains for the purposes of increasing the grain size or rendering the grain size distribution of the formed silver halide uniform. However, in the present invention, even if a trace of the organic thioether compounds which hardly affects the grain size distribution is used, high contrast emulsions having high photographic sensitivity and less fog can be obtained.

Various silver halides can be employed in the present invention, but silver iodobromide (iodine content: 0.5 to 10 mol%) is particularly preferred, and silver halides having an average grain size of about 0.2 to about 2.5 microns are preferred.

Methods for forming silver halide grains which can be used in the present invention in addition to the above are described in, e.g., U.S. Pat. Nos. 2,222,264, 2,592,250, 3,206,313, 3,447,927 and 3,501,307, British Patents 723,019 and 1,027,146, *The Journal of Photographic Science,* Vol. 12, pages 242–251 (1963), ibid., Vol. 13, pages 85–89 (1965), ibid., Vol. 13, pages 98–107 (1965), etc.

Emulsions containing the thus-formed silver halide grains are washed with water using methods as described in U.S. Pat. Nos. 2,618,556, 2,614,928, 2,565,418, 2,489,341, etc., and transferred to a subsequent chemical ripening.

There are no particular limitations on the chemical ripening and reference can be made to the description in U.S. Pat. Nos. 1,623,499, 2,399,083, 2,618,556, 2,614,928, 2,565,418, 2,489,341, 3,297,447, etc. In particular, sensitization using noble metals such as gold compounds or the like and sensitization using sulfur compounds can be advantageously employed.

The amount of the organic thioether compound added during chemical ripening preferably is about 0.001 to 1 g, more preferably 0.01 to 0.2 g, per mol of silver halide.

The characteristic of the present invention resides in preventing an increase in fog by adding at least one compound represented by the formulae (I), (II) and/or (III) to the emulsion, whereby the photographic sensitivity is increased by the organic thioether compound as described above, during chemical ripening or immediately before coating. It is most preferred for the compound represented by the formulae (I), (II) and/or (III) to be added during chemical ripening. The compounds represented by the formulae (I), (II) and (III) are explained in detail below.

As described above, Z can be an alkyl group having 1 to 8 carbon atoms (e.g., a methyl group, an ethyl group, etc.), an aryl group having 6 to 18 carbon atoms (e.g., a phenyl group) or a heterocyclic group (e.g., a 5- or 6-membered heterocyclic group containing one or more of a sulfur atom, an oxygen atom and a nitrogen atom as hetero atoms and 1 to 5 carbon atoms). Suitable aromatic rings having 6 to 18 carbon atoms formed by Y include a phenyl group and suitable heterocyclic rings formed by Y are as described above for the heterocyclic group for Z.

The alkyl group, the aryl group, the heterocyclic group, the aromatic ring and the heterocyclic ring represented by Z and Y in the formulae (I), (II) and (III) can be unsubstituted or substituted.

Suitable substituents include, e.g., a lower alkyl group having 1 to 4 carbon atoms such as a methyl group, an ethyl group, etc.; an aryl group such as a phenyl group, etc.; an alkoxy group having 1 to 8 carbon atoms such as a methoxy group, an ethoxy group, etc.; a halogen atom such as a chlorine atom, etc.; a nitro group; an amino group; a carboxyl group and the like.

Examples of heterocyclic rings represented by Z and Y include thiazole, benzothiazole, imidazole, benzimidazole and oxazole rings, etc.

Examples of preferred metal ions represented by M are alkali metal ions such as sodium ions, potassium ions, etc., and examples of organic cations include ammonium ions, such as a tetramethyl ammonium ion and a tetraethylammonium ion, a guanidine group ion, etc.

Specific examples of compounds represented by the formulae (I), (II) and (III) include the following compounds.

(a)

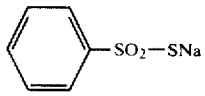

(b)

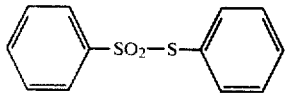

(c)

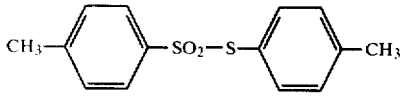

(d)

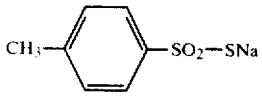

(e) $CH_3-SO_2-SNa$ (f)

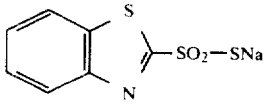

(g)

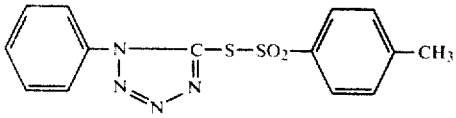

-continued (h)

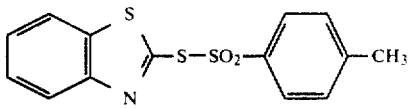

(i)

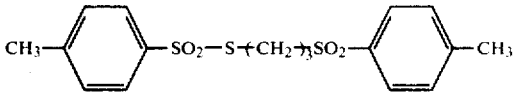

(j)

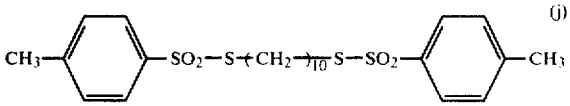

The compounds of the formula (I), (II) and/or (III) can be synthesized in accordance with well known methods.

For example, they can be synthesized by a method which comprises reacting the corresponding sulfonyl chloride with sodium sulfide or by a method which comprises reacting the corresponding sodium sulfinate with sulfur. Some of these compounds are commercially available.

The amount added of the compound represented by the formulae (I), (II) and/or (III) of the present invention is preferably in a range of from about 0.001 to about 1 g, more preferably 0.01 to 0.2 g, per mol of silver halide.

There are no specific limitations on conditions for the chemical ripening in the present invention, e.g., pH, pAg, temperature, time, additives, or the like, and the chemical ripening can be performed employing conventional conditions used in the photographic art.

For example, a pH range of from 3.0 to 8.5 is preferred, particularly 5.0 to 7.5; a pAg range of 7.0 to 9.5 is preferred, particularly 8.0 to 9.3; a temperature of 40° to 85° C., particularly 45° to 75° C. is preferred; and a time of 10 to 200 minutes, especially 30 to 120 minutes, is preferred.

Typical examples of chemical sensitizers which can be employed in the emulsion of the present invention include gold(III) chloride, gold(I) sulfide, gold potassium thiocyanate, potassium chloroaurate, ammonium chloroplatinate, ruthenium, rhodium, palladium, iridium compounds, iminoaminomethane sulfinic acid, diethylene triamine, thiourea dioxide, allyl isothiocyanate, thiourea, allyl thiourea, thioacetamide, allyl selenourea, allyl tellurourea, etc.

Additives which are called coating finals in the photographic art are added to the thus chemically ripened emulsion and the coating solution is coated into a variety of supports and then dried to obtain a silver halide photographic material.

The additives to the emulsion other than the organic thioether compound and the compound represented by the formulae (I), (II) and/or (III) in the present invention are not specifically limited. For example, thiosulfates, thioureas, thiazoles, rhodanines and other compounds can be employed as sulfur sensitizers as described in U.S. Pat. Nos. 1,574,944, 2,410,689, 2,278,947, 2,728,668 and 3,656,955. Tin(I) salts, amines, hydrazine derivatives, formamidinesulfinic acid, silane compounds, etc., as described in U.S. Pat. Nos. 2,487,850, 2,419,974, 2,518,698, 2,983,609, 2,983,610 and 2,694,637 can be employed as reducing sensitizers. For sensitization with noble metals, besides gold complexes, complexes of metals of Group VIII in the Periodic Table, such as platinum, iridium, palladium, etc., can be used, as described in U.S. Pat. Nos. 2,399,083, 2,448,060, British Patent 618,061, etc.

In addition, for the purposes of increasing sensitivity, increasing contrast or accelerating development, the emulsion can contain, for example, polyalkylene oxides or derivatives thereof such as ethers, esters, amines, etc., thioether compounds, thiomorpholine compounds, quaternary ammonium compounds, urethane derivatives, urea derivatives, imidazole derivatives, 3-pyrazolidones, etc. For example, the compounds as described in U.S. Pat. Nos. 2,400,532, 2,423,549, 2,716,062, 3,617,280, 3,772,021, 3,808,003, etc., can be used.

In addition, for purposes of preventing fog or stabilizing the photographic properties during preparation, during storage or during photographic processing of light sensitive materials, a variety of compounds can be incorporated into the material. A wide variety of compounds which are known as anti-fogging agents or stabilizers, such as azoles, e.g., benzothiazolium salts, nitrobenzimidazoles, nitroindazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines; thio keto compounds, such as oxazolinethione; azaindenes, e.g., triazaindenes, tetrazaindenes (especially 4-hydroxy-substituted (1,3,3*a*,7-)tetrazaindene), pentazaindenes, etc.; benzenesulfinic acid, benzenesulfonic amide, etc., can be used.

It is advantageous in the present invention to employ gelatin as a binder or a protective colloid for the photographic emulsion in the present invention, but other hydrophilic colloids can also be employed.

For example, a variety of synthetic hydrophilic high molecular weight materials such as graft polymers of gelatin and other high molecular weight materials; proteins such as albumin, casein, etc.; cellulose derivatives such as hydroxyethyl cellulose, carboxymethyl cellulose, cellulose sulfate, etc.; saccharide derivatives such as sodium alginate, starch derivatives, etc.; homopolymers or copolymers such as polyvinyl alcohol, polyvinyl alcohol-partial acetal, poly-N-vinylpyrrolidone, polyacrylic acid, polymethacrylic acid, polyacrylamide, polyvinylimidazole, polyvinylpyrazole, etc., can be employed.

In addition, lime-treated gelatin and acid-treated gelatin can be used as the gelatin and, further, gelatin hydrolysates as well as enzyme-processed gelatin can similarly be used. Suitable gelatin derivatives which can be employed are those obtained by reacting, with gelatin, a variety of compounds such as acid halides, acid anhydrides, isocyanates, bromoacetic acid, alkane sultones, vinylsulfonamides, maleic imide compounds, polyalkylene oxides, epoxy compounds, etc. Specific examples of these compounds are described in, for example, U.S. Pat. Nos. 2,614,928; 3,132,945, 3,186,846, and 3,312,553, British Pat. Nos. 861,414, 1,033,189 and 1,005,784, Japanese Pat. Publication No. 26845/67, etc.

Suitable gelatin-graft polymers which can be employed are those obtained by grafting homopolymers or copolymers of vinyl monomers such as acrylic acid, methacrylic acid, derivatives thereof such as the esters, amides, etc., thereof, acrylonitrile, styrene, etc., to gelatin. In particular, graft polymers of gelatin with polymers which are compatible with gelatin to some extent, e.g., polymers of acrylic acid, methacrylic acid, acrylamide, methacrylamide, hydroxyalkyl methacrylates, etc., are preferred. Examples of these graft polymers are described in U.S. Pat. Nos. 2,763,625, 2,831,767, 2,956,884, etc.

Further, the photographic emulsion layers or other hydrophilic colloid layers of the light-sensitive material prepared in accordance with the present invention can also contain a variety of known surface active agents for various purposes such as coating aids, preventing the formation of static charges, improving lubrication, improving emulsion-dispersion, preventing adhesion, improving the photographic properties (e.g., acceleration in development, enhanced contrast, sensitization), etc.

For example, nonionic surface active agents such as saponin (steroid type), alkylene oxide derivatives (e.g., polyethylene glycol, polyethylene glycol/polypropylene glycol condensates, polyethylene glycol alkyl or alkylaryl ethers, polyethylene glycol esters, polyethylene glycol sorbitan esters, polyalkylene glycol alkylamines or amides, polyethylene oxide adducts of silicones, glycidol derivatives (e.g., alkenylsuccinic acid polyglycerides, alkylphenol polyglycerides), fatty acid esters of polyvalent alcohols, alkyl esters of sucrose, urethanes or ethers thereof, etc.; anionic surface active agents containing an acid group such as a carboxyl group, a sulfo group, a phospho group, a sulfuric acid ester group, a phosphoric acid ester group, etc., such as triterpenoid type saponin, alkyl carbonates, alkyl sulfonates, alkylbenzene sulfonates, alkylnaphthalene sulfonates, alkylsulfates, alkyl phosphates, N-acyl-N-alkyltaurines, sulfosuccinic acid esters, sulfoalkyl polyoxyethylene alkylphenyl ethers, polyoxyethylene alkylphosphates, etc.; amphoteric surface active agents such as amino acids, aminoalkyl sulfonic acids, aminoalkyl sulfates or phosphates, alkyl betaines, amineimides, amine oxides, etc.; cationic surface active agents, e.g., aliphatic or aromatic quaternary ammonium salts, heterocyclic quaternary ammonium salts such as pyridinium or imidazolium, etc., phosphonium or sulfonium salts containing aliphatic or heterocyclic rings, etc., can be used.

Specific examples of these surface active agents are described in U.S. Pat. Nos. 2,240,472, 2,831,766, 3,158,484, 3,210,191, 3,294,540 and 3,507,660, British Pat. Nos. 1,012,495, 1,022,878, 1,179,290 and 1,198,450, Japanese Patent application (OPI) No. 117,414/75 (The term "OPI" as used herein refers to a "published unexamined Japanese patent application"), U.S. Pat. Nos. 2,739,891, 2,823,123, 3,068,101, 3,415,649, 3,666,478 and 3,756,828, British Pat. 1,397,218, U.S. Pat. Nos. 3,133,816, 3,441,413, 3,475,174, 3,545,974, 3,726,683 and 3,843,368, Belgian Pat. No. 731,126, British Pat. Nos. 1,138,514, 1,159,825 and 1,374,780, Japanese Patent Publications No. 378/65, 379/65 and 13822/68, U.S. Pat. Nos. 2,271,623, 2,288,226, 2,944,900, 3,253,919, 3,671,247, 3,772,021, 3,589,906, 3,666,478 and 3,754,924, German Patent Application (OLS) 1,961,638, Japanese Patent Application (OPI) No. 5902/75, etc.

The photographic emulsion layers or the other hydrophilic colloid layers of the photographic light-sensitive material prepared in accordance with the present invention can also contain dispersions of water-insoluble or slightly soluble synthetic polymers, for purposes of improving the dimensional stability or the like.

For example, polymers comprising as a monomer component, individually or in combination, alkyl (meth-)acrylates, alkoxyalkyl (meth)acrylates, glycidyl (meth-)acrylates, (meth)acrylamides, vinyl esters (e.g., vinyl acetate), acrylonitrile, olefins, styrene, etc., or combination thereof with acrylic acid, methacrylic acid, $\alpha,\beta$-unsaturated dicarboxylic acids, hydroxyalkyl (meth)acrylates, sulfoalkyl (meth)acrylates, styrene sulfonic acid, etc., can be employed. For example, those polymers as described in U.S. Pat. Nos. 2,376,005, 2,739,137, 2,853,457, 3,062,674, 3,411,911, 3,488,708, 3,525,620, 3,607,290, 3,635,715 and 3,645,740, British Patents 1,186,699 and 1,307,373 can be employed.

The photographic emulsion of the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Any conventionally utilized nucleus for cyanine dyes such as basic heterocyclic nuclei is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and, further, nuclei formed by fusing aromatic hydrocarbon rings with these nuclei, that is, an indolenine nucleus, a benzindolenine nucleus, an indole nucleus, a benzoxazole nucleus, a naphthaoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

Merocyanine dyes or complex merocyanine dyes containing 5- or 6-membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus, a thiobarbituric acid nucleus, etc., can be employed.

Useful sensitizing dyes are those described in German Pat. No. 929,080, U.S. Pat. Nos. 2,231,658, 2,493,748, 2,503,776, 2,519,001, 2,912,329, 3,656,959, 3,672,897 and 3,694,217, British Pat. No. 1,242,588, Japanese Patent Publication No. 14030/69, etc.

These sensitizing dyes can be employed individually, and can also be employed in combination. A combination of sensitizing dyes is often used particularly for the purpose of super sensitization. Representative examples thereof are described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609 and 3,837,862, British Pat. No. 1,344,281, Japanese Patent Publication 4936/68, etc.

The photographic emulsion layers and other hydrophilic colloid layers of the light-sensitive material prepared in accordance with the present invention can contain whitening agents such as stilbenes, triazines, oxazoles, or coumarins, etc. These agents can be water-soluble or can also be employed as a dispersion of water-insoluble whitening agents. Specific examples of fluorescent whitening agents are described in U.S. Pat. Nos. 2,632,701, 3,269,840 and 3,359,102, British Pat. Nos. 852,075 and 1,319,765, etc.

The hydrophilic colloid layers of the light-sensitive material prepared using the present invention can contain water-soluble dyes such as filter dyes or for various purposes of preventing irradiation or other surposes. Such dyes include oxonol dyes, hemioxonol dyes, styryl dyes, merocyanine dyes, cyanine dyes and azo dyes. Of these dyes, oxonol dyes, hemioxonol dyes and merocyanine dyes are useful. Specific examples of dyes which can be employed are described in British Pat. Nos. 584,609 and 1,177,429, Japanese Patent Applications (OPI) 85130/73, 99620/74 and 114420/74, U.S. Pat. Nos. 2,274,782, 2,533,472, 2,956,879, 3,148,187, 3,177,078, 3,247,127, 3,540,887, 3,575,704, 3,653,905 and 3,718,472.

The photographic emulsion in accordance with the present invention can also contain color image forming couplers, that is, compounds which react with the oxidation product of an aromatic amine (ordinarily a primary aromatic amine) developing agent to form dyes (hereafter simply referred to as a "coupler"). Non-diffusible couplers which contain a hydrophobic group, called a ballast group, in the molecule thereof are preferred as couplers. Couplers can be 4-equivalent or 2-equivalent couplers. In addition, colored couplers providing a color correction effect or couplers which release developing inhibitors upon development (the so-called DIR couplers) can also be present therein. Also, couplers which provide a colorless product on coupling can be employed.

Conventional open chain ketomethylene type couplers can be employed as yellow forming couplers. Of these couplers, benzoyl acetanilide type and pivaloyl acetanilide type compounds are especially effective. Specific examples of yellow forming couplers which can be employed are described in U.S. Pat. Nos. 2,875,057, 3,265,506, 3,408,194, 3,551,155, 3,582,322, 3,725,072 and 3,891,445, German Pat. No. 1,547,868, German Patent Applications (OLS) 2,213,461, 2,219,917, 2,261,361, 2,263,875 and 2,414,006, etc.

Pyrazolone type compounds, indazolone type compounds, cyanoacetyl compounds, etc., can be employed as magenta couplers and particularly preferred couplers are pyrazolone type compounds. Specific examples of magenta color forming couplers which can be employed are those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Pat. applications (OLS) Nos. 2,408,665, 2,417,945, 2,418,959 and 2,424,467, Japanese Patent Publication No. 6031/65, etc.

Phenol type compounds and naphthol type compounds can be employed as cyan couplers. Specific examples of these couplers include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383 and 3,767,411, German Patent applications (OLS) No. 2,414,830 and 2,454,329, Japanese Patent application (OPI) No. 59838/73, etc.

Colored couplers which can be employed are those described in U.S. Pat. Nos. 3,476,560, 2,521,908, 3,034,892, Japanese Patent Publications 2016/69, 22335/63, 11304/67 and 32461/69, Japanese Patent Applications Nos. 98469/74 and 118029/75, German Patent Application (OLS) No. 2,418,959, etc.

DIR couplers which can be employed are those described in, e.g., U.S. Pat. Nos. 3,227,554, 3,617,291, 3,701,783, 3,790,384 and 3,632,345, German Patent applications (OLS) Nos. 2,414,006, 2,454,301 and 2,454,329, British Pat. Nos. 953,454, Japanese Patent application No. 146570/75, etc.

In addition to DIR couplers, compounds which release developing inhibitors upon development can also be present in the light-sensitive material. For example, those DIR couplers as described in U.S. Pat. Nos. 3,297,445 and 3,379,529, and German Patent application (OLS) No. 2,417,914 can be employed.

Two or more kinds of the couplers described above can be incorporated in the same layer or the same coupler compound can also be present in two or more layers.

Conventional methods, e.g., the method described in U.S. Pat. No. 2,322,027, can be employed to incorporate the couplers into the silver halide emulsion layers. For example, the couplers can be dissolved in phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate), citric acid esters (e.g., tributyl acetylcitrate), benzoic acid esters (e.g., octyl benzoate), alkyl amides (e.g., diethyl laurylamide), etc.; or organic solvents having a melting point of about 30 to about 150° C., e.g., lower alkyl acetates such as ethyl acetate, butyl acetate, ethyl propionate, sec-butyl alcohol, methyl isobutyl ketone, $\beta$-ethoxyethyl acetate, methyl Cellosolve acetate, etc., and the resulting solutions dispersed in a hydrophilic colloid. The high boiling point solvents and low boiling point organic solvents described above can also be employed as a mixture thereof.

Where the couplers have acid groups such as a carboxylic acid group or a sulfonic acid group, they can be incorporated into the hydrophilic colloid as an alkaline aqueous solution thereof.

These couplers are incorporated into the emulsion layers, generally in an amount of about $2\times10^{-3}$ mol to about $5\times10^{-1}$ mol, preferably $1\times10^{-2}$ mol to $5\times10^{-1}$ mol, per mol of silver.

The light-sensitive material prepared using the present invention can also contain, as color fog preventing agents, hydroquinone derivatives, aminophenol derivatives, gallic acid derivatives, or the like. Specific examples of these agents are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent applications (OPI) Nos. 92988/75, 92989/75, 93928/75 and 110337/75, Japanese patent Publication No. 23813/75, etc.

The hydrophilic colloid layers of the light-sensitive material prepared in accordance with the present invention can also contain UV absorbents. For example, benzotriazole compounds substituted with aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,705,375 and 3,705,805), or benzoxazole compounds (e.g., those described in U.S. Pat. No. 3,499,762) can be employed. U.V. absorbing couplers (e.g., $\alpha$-naphthol type cyan color forming couplers) or UV absorbing polymers can also be employed. These UV absorbents can also be mordanted in a specific layer(s), if desired.

The photographic emulsion of the present invention is coated onto a flexible support such as a synthetic resin film, a paper, cloth, etc., or onto rigid supports such as glass, ceramics, metals, etc., which are conventionally employed for photographic light-sensitive materials, using a dip coating method, a roller coating method, a curtain coating method, an extrusion coating method, etc. Useful flexible supports are films of semi-synthetic or synthetic high molecular weight materials such as cellulose nitrate, cellulose acetate, cellulose acetate butyrate, polystyrene, polyvinyl chloride, polyethylene terephthalate, polycarbonate, etc.; or paper on which a baryta layer or an $\alpha$-olefin polymer (e.g., polyethylene, polypropylene, ethylene/butene copolymers), etc., is coated or laminated. These supports can also be colored using dyes or pigments, and, further, blackened for the purpose of shielding light. The surface of these supports is generally subjected to a subbing treatment in order to improve the adhesion to photographic emulsion layers or the like. The support surface can also be subjected to a corona discharge treatment, an ultraviolet light irradiation treatment or a flame treatment, prior to or after the subbing treatment.

The present invention is also applicable to multilayer multi-color photographic materials containing layers sensitive to at least two different spectral wavelength ranges on a support. A multilayer color photographic material generally possesses at least one red-sensitive silver halide emulsion layer, at least one green-sensitive silver halide emulsion layer and at least one blue-sensitive silver halide emulsion layer, respectively, on a support. The order of these layers can be varied optionally as desired. Ordinarily, a cyan forming coupler is present in a red-sensitive emulsion layer, a magenta forming coupler is present in a green-sensitive emulsion layer and a yellow forming coupler is present in a blue-sensitive emulsion layer, respectively. However, if necessary, a different combination can be employed.

The exposure for obtaining photographic images using the photographic material of the present invention can be performed in accordance with conventional techniques. That is, light from a variety of known light sources such as natural light (sunlight), a tungsten lamp, a fluorescent lamp, a mercury lamp, a xenon arc lamp, a carbon arc lamp, a xenon flash lamp, a cathode ray tube flying spot, etc., can be employed. Exposure times of 1/1,000 to 1 second ordinarily used for a camera can be employed. Of course, an exposure time shorter than 1/1,000 second, e.g., $1/10^4$ to $1/10^6$ second using a xenon flash lamp or a cathode ray tube, can also be used, and an exposure time longer than 1 second can also be used. If desired, the spectral composition of the light used for the exposure can be controlled using a color filter. A laser beam can also be employed for exposure. In addition, exposure can also be achieved using light emitted from fluorescent substances excited with electron beams, X-rays, $\gamma$-rays, $\alpha$-rays, etc.

Conventional photographic processing methods can be used for processing the light-sensitive material prepared by applying the present invention after exposure. The processing temperature can be between about 18° C. and about 50° C., in general, but a temperature lower than 18° C. or exceeding 50° C. can be used, is desired. Either a development processing for forming silver images (black and white photographic processing) or a color photographic processing comprising developing processing for forming dye images can be employed, as desired.

Suitable developing solutions which can be employed in the case of black and white photographic processing can contain known developing agents such as dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and the like, either individually or in combination. In general, the developing solutions can additionally contain known preservatives, alkali agents, pH buffering agents, anti-fogging agents, etc., and, if necessary, can further contain solubilizing agents, color toning agents, developing accelerators, surface active agents, defoaming agents, water softeners, hardening agents, viscosity-imparting agents, etc.

Conventional fixing solutions can be employed. In addition to thiosulfates and thiocyanates, organic sulfur compounds known as fixing agents can be employed as fixing agents. The fixing solutions can also contain water-soluble aluminum salts as hardening agents.

Conventional methods of forming color images can be used. For example, a nega-posi method (e.g., as described in *Journal of the Society of Motion Picture and Television Engineers*, Vol. 61, pages 667-701 (1953)), a color reversal method which comprises developing with a developer containing a black and white developing agent to form a negative silver image, then subjecting the photographic material to at least one uniform exposure or to another appropriate fogging treatment, and subsequently performing color development to obtain positive dye images; a silver dye bleaching method which comprises exposing a dye-containing photographic emulsion layer and developing the same to form a silver image and then bleaching the dyes using the silver image as a bleaching catalyst; etc., can be employed.

A color developer generally comprises an alkaline aqueous solution containing a color developing agent. Suitable color developing agents which can be employed include known primary aromatic amine developing agents, e.g., phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfamidoethylaniline, 4-amino-3-methyl-N-ethyl-N-β-methoxyethylaniline, etc.).

In addition, those developing agents described in L. F. A. Mason, *Photographic Processing Chemistry*, pages 226 to 229, Focal Press (1966), U.S. Pat. Nos. 2,193,015 and 2,592,364, Japanese Patent application (OPI) No. 64933/73, etc., can be employed.

The color developers can also contain pH buffering agents such as sulfites, carbonates, borates and phosphates of alkali metals, developing inhibitors or anti-fogging agents such as bromides, iodides or organic anti-fogging agents, etc. In addition, if desired, the color developers can also contain water softeners, preservatives such as hydroxylamine; organic solvents such as benzyl alcohol, diethylene glycol, etc.; developing accelerators such as polyethylene glycol, quaternary ammonium salts, amines; dye forming couplers; competing couplers; fogging agents such as sodium borohydride; auxiliary developers such as 1-phenyl-3-pyrazolidone; viscosity-imparting agents, etc.

The photographic emulsion layers after color development are generally bleach-processed. Bleach processing can be performed at the same time as fixing or separately therefrom. Suitable bleaching agents which can be employed are compounds of polyvalent metals such as iron (III), cobalt (IV), chromium (VI), copper (II), etc., peracids, quinones, nitroso compounds, etc. Specific examples include ferricyanides; bichromates; organic complexes of iron (III) or cobalt (III); aminopolycarboxylic acids such as ethylenediaminetetraacetic acid, nitrilotriacetic acid, 1,3-diamino-2-propanol tetraacetic acid, etc.; complexes of organic acids such as citric acid, tartaric acid, malic acid, etc.; persulfates; permanganates; nitrosophenol; etc. Of these, particularly useful bleaching agents are potassium ferricyanide, sodium ethylenediaminetetraacetate iron (III) and ammonium ethylenediaminetetraacetate iron (III). Ethylenediaminetetraacetate iron (III) complex is useful both in a bleaching solution and in a mono bath bleach-fixing solution.

Bleaching and bleach-fixing solutions can contain various additives including bleach accelerating agents as described in U.S. Pat. Nos. 3,042,520 and 3,241,966, Japanese Pat. publications Nos. 8506/70 and 8836/70, etc.

Various additives, processing methods and the like, as described above, are described in *Product Licensing Index*, Vol. 92, pages 107-110 (December, 1971), in addition to the above.

The photographic emulsion in accordance with the present invention can be advantageously applied to many types of silver halide photographic light-sensitive materials because it provides high photographic sensitivity, high contrast and less fogging.

For example, the emulsion of the present invention can be particularly advantageously applied to highly sensitive black and white negative films, X-ray films for medical use, multilayer color negative films, etc.

In recent years, these light-sensitive materials have been often subjected to developing processing at temperatures, e.g., higher than 35° C. so that fog tends to occur with the elevated developing temperature. In particular, this tendency is marked in color development. The present invention can be particularly advantageously applied to such a light-sensitive material processed at high temperatures, especially to color light-sensitive materials processed at high temperatures.

The present invention is explained in greater detail with reference to the examples below. Unless otherwise indicated, all parts, percents, ratios and the like are by weight.

EXAMPLE 1

To an aqueous solution containing gelatin, potassium iodide and a small amount of potassium bromide, an aqueous solution of potassium bromide and an aqueous solution of silver nitrate were simultaneously added with vigorous stirring while keeping the temperature at 70° C. Thus, silver iodobromide Emulsions 1 through 8 containing about 5 mol% of silver iodide and having an average grain size of about 0.5 micron were obtained.

The organic thioether compounds in accordance with the present invention, as shown in Table 1, were present in the aqueous gelatin solution.

The pH value and pAg value were maintained in a fixed range during the precipitation.

These emulsions were cooled and gelled in a conventional manner and washed with cold water to remove insoluble salts.

The pH value and the pAg value of the emulsions after water washing were adjusted to a fixed range and thereafter the emulsions were warmed to 60° C. Sodium thiosulfate and potassium chloroaurate were added thereto and chemical ripening was performed for 70 minutes in the presence of the thiosulfonic acid compounds, as shown in Table 1, in accordance with the present invention.

To the thus-obtained emulsions, the hardening agent, stabilizing agent and coating aid as indicated below were added as finals. Thereafter, each of the resulting solutions was coated onto a cellulose triacetate film support in a silver coating amount of 5.0 g/m$^2$, followed by drying. Thus, photographic light-sensitive materials were obtained.

Hardening Agent: 2,4-Dichloro-6-hydroxy-s-triazine
Stabilizing Agent: 4-Hydroxy-6-methyl-1,3,3a,7-tetrazaindene
Coating Aid: Sodium dodecylbenzenesulfonate The thus-obtained photographic light-sensitive materials were exposed using a sensitometer through an optical wedge and developed at 35° C. for 30 seconds with RD-III for an automatic developer (trade name, made by Fuji Photo Film Co., Ltd.). After fixing, water washing and drying in a conventional manner, the photographic properties (photographic sensitivity and fog) were evaluated and the results as shown in Table 1 were obtained.

For reference, the photographic sensitivity is expressed by the reciprocal of the logarithm of the exposure amount required for obtaining an optical density of fog+0.20. In Table 1, the sensitivity of Sample-1 (Emulsion-1) was made 100 and the others were expressed relative thereto.

The amounts of the organic thioether compounds and thiosulfonic acid compounds in Table 1 added are amounts per mol of silver halide.

Table 1

| Sample No. (emulsion no.) | Organic Thioether Compound | Amount Added (g) | Thiosulfonic Acid Compound | Amount Added (g) | Photographic Property Sensitivity | Fog |
|---|---|---|---|---|---|---|
| 1 | — | — | — | — | 100 | 0.08 |
| 2 | Compound-1 | 1.0 | — | — | 151 | 0.14 |
| 3* | " | 1.0 | Compound-a | 0.003 | 158 | 0.08 |
| 4 | " | 1.0 | Sodium benzene-sulfonate | 0.003 | 151 | 0.14 |
| 5 | Compound-6 | 0.5 | — | — | 141 | 0.18 |
| 6* | " | 0.5 | Compound-b | 0.002 | 154 | 0.10 |
| 7 | Compound-11 | 0.2 | — | — | 141 | 0.12 |
| 8* | " | 0.2 | Compound-a | 0.003 | 144 | 0.08 |

*Invention

As can be clearly seen from the results in Table 1, the emulsion prepared by forming silver iodobromide grains in the presence of the organic thioether compounds in the aqueous gelatin solution (Sample Nos. 2, 5 and 7) provide increased sensitivity but increased fog, too.

When the thiosulfonic acid compounds were also present in the emulsion during the chemical ripening thereof (Sample Nos. 3, 6 and 8), the sensitivity can be increased without an accompanying increase in fog.

On the other hand, the effects as achieved by the present invention are not obtained with Sample 4 in which sodium benzenesulfonate, which is a comparison compound for the thiosulfonic acid compounds, was allowed to be present during chemical ripening.

EXAMPLE 2

In a manner similar to Example 1, silver iodobromide grains were formed to prepare emulsions. The emulsions were cooled and gelled and then washed with cold water to remove insoluble salts, in a manner similar to Example 1.

After adjusting the pH and pAg of the emulsions after water washing to a fixed range, the emulsions were warmed again to 61° C. and subjected to chemical ripening for 60 minutes in the presence of the organic thioether compounds and thiosulfonic acid compounds as shown in Table 2 to prepare Emulsions 11 through 15. In Emulsions 11 through 15, sodium thiosulfate and potassium chloroaurate were present during chemical ripening in a manner similar to Example 1. To the thus-obtained emulsions, the finals indicated below were added.

Coupler: 1-(2,4,6-Trichlorophenyl)-3-[3-(2,4-di-t-amyl-phenoxy)acetamido]benzamido-5-pyrazolone (0.75 g/m$^2$)
Spectral Sensitizer: bis(9-Ethyl-5-phenyl-3-ethyl)-oxycarbo-cyanine isothiocyanate (5.2 mg/m$^2$)
Hardening Agent: 2,4-Dichloro-6-hydroxy-1,3,5-triazine sodium salt (14 mg/m$^2$)
Coating Aid: Sodium p-dodecylbenzenesulfonate (51 mg/m$^2$); Sodium p-nonylphenoxypoly-(ethyleneoxy)propane sulfonate (60 mg/m$^2$)

The resulting solutions were coated and dried to obtain Sample Nos. 11 through 15 (dry thickness of each emulsion layer: 6.0 microns). The samples were exposed through a yellow filter and then subjected to development processing in accordance with Processing I (with Color Developer C being employed) described in Example 1 of Japanese Pat. application (OPI) 51940/76 (corresponding to German Pat. application (OLS) 2,548,897). Thereafter, the photographic properties were evaluated and the results as shown in Table 2 were obtained.

The sensitivity in Table 2 is expressed relatively, by making that of Sample-11, 100, in a manner similar to Example 1.

Table 2

| Sample No. (emulsion no.) | Organic Thioether Compound | Amount Added (g) | Thiosulfonic Acid Compound | Amount Added (g) | Photographic Property Sensitivity | Fog |
|---|---|---|---|---|---|---|
| 11 | — | | — | | 100 | 0.15 |
| 12 | Compound-1 | 0.03 | — | | 112 | 0.18 |
| 13* | " | 0.03 | Compound-a | 0.003 | 126 | 0.16 |
| 14 | Compound-3 | 0.03 | — | | 110 | 0.20 |

Table 2-continued

| Sample No. (emulsion no.) | Organic Thioether Compound | Amount Added (g) | Thiosulfonic Acid Compound | Amount Added (g) | Photographic Property Sensitivity | Photographic Property Fog |
|---|---|---|---|---|---|---|
| 15* | " | 0.03 | Compound-b | 0.002 | 129 | 0.18 |

*Invention

As is clearly seen from the results in Table 2, Samples 13 and 15 in accordance with the present invention in which the organic thioether compounds and the thiosulfonic acid compounds were present during chemical ripening showed high sensitivity and comparatively less fog, which properties are extremely preferred.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing at least one organic thioether compound in an amount sufficient for sensitizing, wherein said organic thioether compound is represented by formulae (C) to (H):

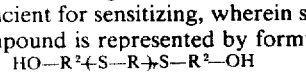
(C)

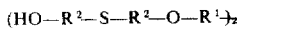
(D)

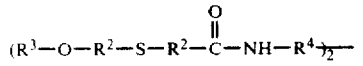
(E)

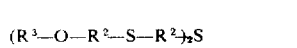
(F)

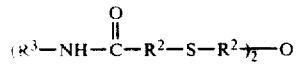
(G)

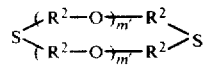
(H)

wherein r' is an integer of 0 to 3; m' is an integer of 1 or 2; $R^2$ and $R^4$ each is an alkylene group having 1 to 5 carbon atoms and $R^3$ is an alkyl group having 1 to 5 carbon atoms and at least one compound represented by the formulae (I), (II) and/or (III):

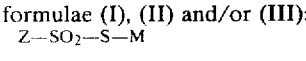
(I)

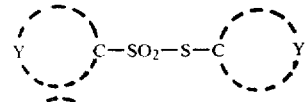
(II)

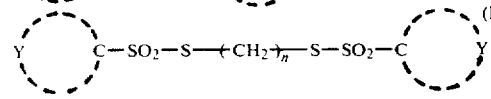
(III)

wherein Z is an alkyl group having 1 to 18 carbon atoms, an aryl group having 6 to 18 carbon atoms or a heterocyclic group; Y represents the atoms necessary for forming an aromatic ring having 6 to 18 carbon atoms or a heterocyclic ring; M is a metal ion or an organic cation; and n is an integer of 2 to 10, said silver halide exhibiting enhanced sensitivity without increased fogging.

2. The silver halide photographic emulsion of claim 1, wherein said organic thioether compound is

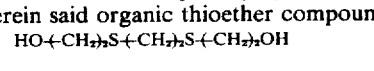

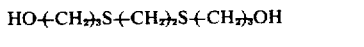

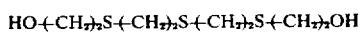

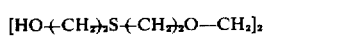

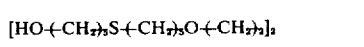

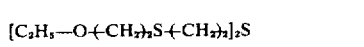

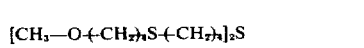

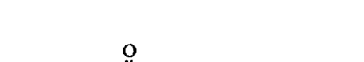

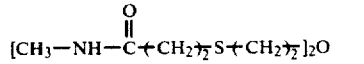

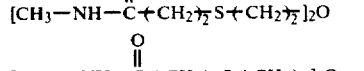

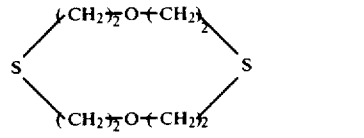

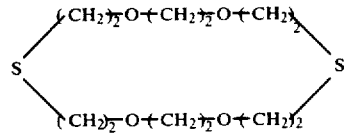

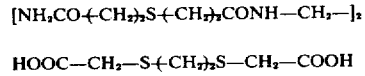

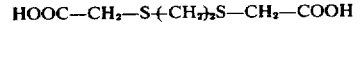

or

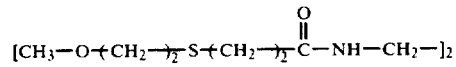

3. The silver halide photographic emulsion of claim 1, wherein said compound represented by the formulae (I), (II) and/or (III) is

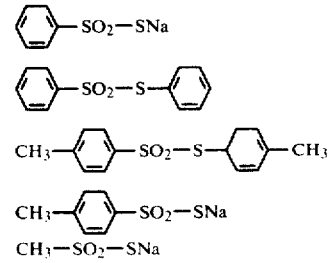

-continued

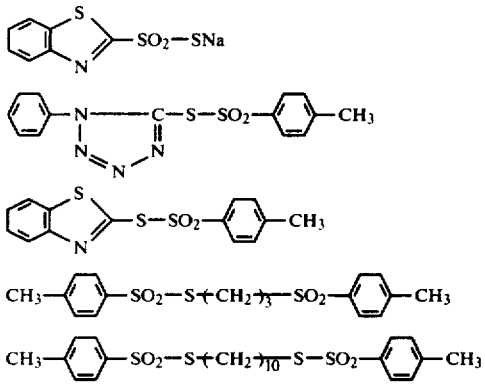

or 1-Cystine-disulfoxide.

4. The silver halide photographic emulsion of claim 1, wherein said organic thioether compound is added to the emulsion (i) during the precipitation of the silver halide grains, (ii) during physical ripening of the silver halide emulsion, (iii) during chemical ripening of the silver halide emulsion, or (iv) immediately before coating, and the compound represented by the formulae (I), (II) and/or (III) is added to the emulsion (a) during chemical ripening of the silver halide emulsion, or (b) immediately before coating.

5. The silver halide photographic emulsion of claim 1, wherein said organic thioether compound is added to the emulsion during precipitation of the silver halide grains, during physical ripening of said silver halide emulsion or during chemical ripening of said silver halide photographic emulsion and said compound represented by the formulae (I), (II) and/or (III) is added during chemical ripening of said silver halide photographic emulsion or prior to coating said silver halide photographic emulsion.

6. A silver halide photographic material comprising a support having thereon at least one silver halide photographic emulsion of claim 1.

7. The silver halide photographic emulsion of claim 1, wherein the organic thioether compound is added in an amount of about 0.01 to about 100 g per mol of silver halide.

8. The silver halide photographic emulsion of claim 1, wherein the amount of the compound represented by formulae (I), (II) and/or (III) is from about 0.001 to about 1 g per mol of silver halide.

9. The silver halide photographic emulsion of claim 7, wherein the amount of the compound represented by formulae (I), (II) and/or (III) is from about 0.001 to about 1 g per mole of silver halide.

10. The silver halide photographic emulsion of claim 9, wherein said organic thioether compound is $HO\text{-}(CH_2)_2S\text{-}(CH_2)_2S\text{-}(CH_2)_2OH$ and said at least one compound represented by formulae (I), (II) and/or (III) is

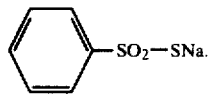

11. The silver halide photographic emulsion of claim 9, wherein said organic thioether compound is $[C_2H_5\text{—}O\text{-}(CH_2)_2S\text{-}(CH_2)_2]_2S$ and said at least one compound represented by formulae (I), (II) and/or (III) is

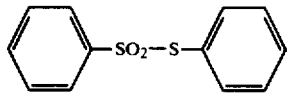

12. The silver halide photographic emulsion of claim 9, wherein said organic thioether compound is

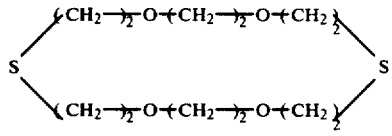

(11)

and said at least one compound represented by formulae (I), (II) and/or (III) is

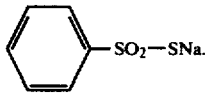

* * * * *